United States Patent [19]

Garza

[11] 4,099,395

[45] Jul. 11, 1978

[54] TUMBLER PIN-TYPE CYLINDER LOCK

[76] Inventor: Roque Villareal Garza, Crozco y Berra 201-203, Ma. la Ribera, Mexico

[21] Appl. No.: 786,994

[22] Filed: Apr. 13, 1977

[30] Foreign Application Priority Data

Apr. 27, 1976 [MX] Mexico ..... 164449
Dec. 3, 1976 [MX] Mexico ..... 167256

[51] Int. Cl.[2] ..... E05B 27/04
[52] U.S. Cl. ..... 70/360; 70/417
[58] Field of Search ..... 70/360, 417, 361, 357, 70/362

[56] References Cited

U.S. PATENT DOCUMENTS 2,910,860 11/1959 Camba ..... 70/360

FOREIGN PATENT DOCUMENTS 815,791 6/1969 Canada ..... 70/360
2,536,804 3/1976 Fed. Rep. of Germany ..... 70/417

*Primary Examiner*—Robert L. Wolfe
*Attorney, Agent, or Firm*—Harold L. Stowell

[57] ABSTRACT

A tumbler pin-type cylinder lock wherein the lock cylinder is mounted for controlled axial or axial and radial movement relative to the lock cylinder housing characterized in that the cylinder is provided with a safety cover and the key and the cylinder have cooperating surfaces for axially shifting the cylinder toward a device actuating position. The cooperating surfaces may comprise the first tumbler and a cooperating portion of the key or the most inner end of the key and a cooperating surface on the cylinder. The assembly also includes a fixed pin in the lock housing which engages a track or groove on the cylinder to thereby control the axial and/or axial and radial positioning of the cylinder relative to the lock housing.

6 Claims, 9 Drawing Figures

Fig 1.
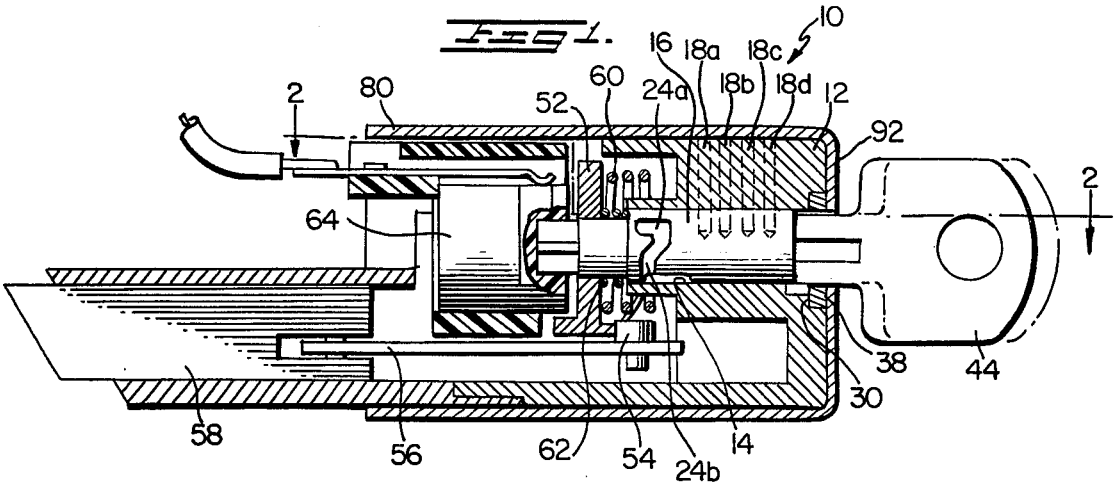
Fig 2.
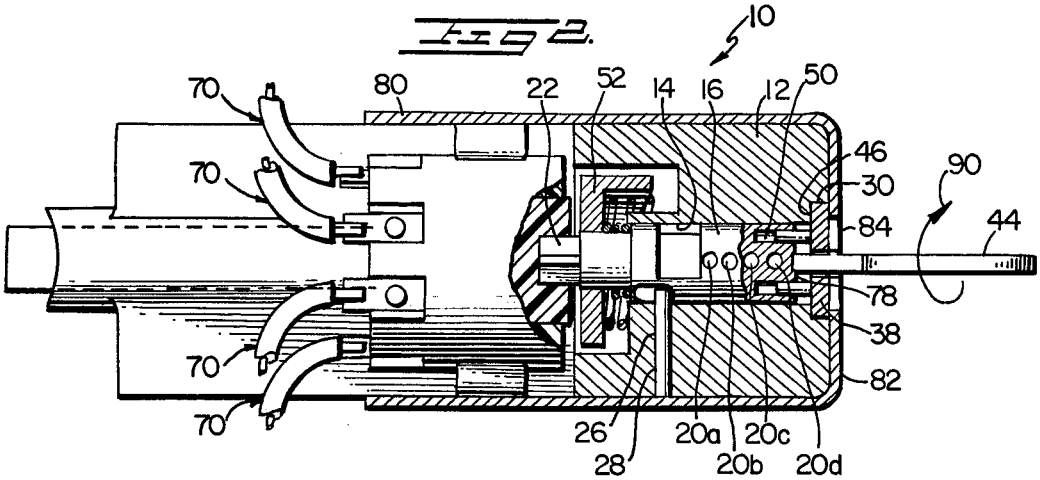
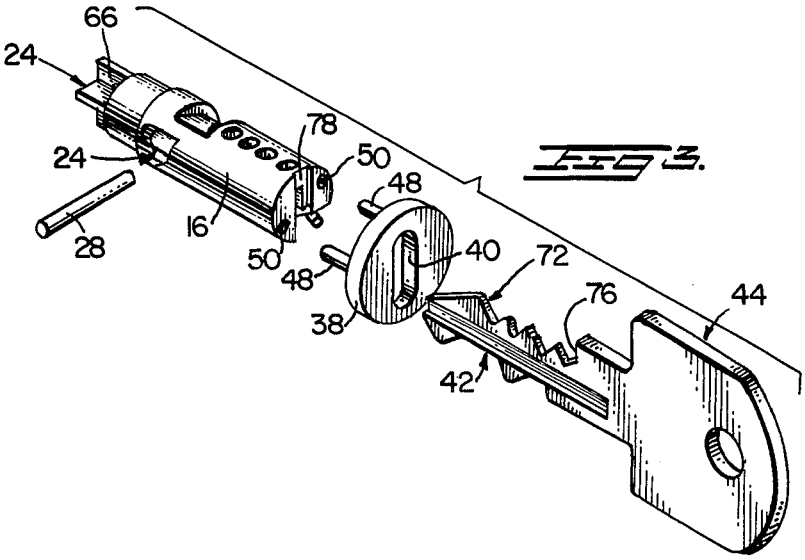
Fig 3.

TUMBLER PIN-TYPE CYLINDER LOCK

BACKGROUND OF THE INVENTION

1. Field of the Invention

This invention relates to improvements in tumbler pin-type cylinder locks which are provided with novel safety means which reduce the chances that the lock can be picked or rendered ineffective.

2. Description of the Prior Art

It is well established that experts in opening locks of the tumbler pin-type can relatively easily force with picklocks, locks which operate solely by rotating the lock cylinder relative to the cylinder housing.

OBJECTS OF THE INVENTION

It is an object of the present invention to provide a tumbler pin-type cylinder lock wherein the cylinder must be moved axially or axially and radially in respect to the lock housing and movement of the lock cylinder in the axial direction is brought about by cooperating surfaces on the lock key and the lock cylinder.

It is another object of the present invention to provide such a tumbler pin-type cylinder lock having a unique protective cover which reduces to a minimum axial movement of the cylinder except by means of the key for the lock.

It is a further object of the present invention to provide a safety cover for tumbler type cylinder locks wherein the safety cover is prevented from moving axially in respect to the cylinder housing but is free to rotate with the lock cylinder relative to the cylinder housing.

It is a further object to provide such a lock provided with a safety cover which is mounted for relative rotation in respect to the cylinder housing and the lock cylinder.

SUMMARY OF THE INVENTION

The hereinbefore objects and advantages of the present invention and others which will be apparent to those skilled in the art are generally provided by a tumbler pin-type cylinder lock comprising a housing having a cylinder bore therein, a plurality of tumbler pin bores in the housing normal to the cylinder bore and intersecting the same, a lock cylinder mounted in the cylinder bore for controlled axial or axial and radial movement relative to the housing, cylinder control tumbler pins mounted in the tumbler pin bores, a key having a profile conforming to the tumbler pin combination and a stop member, said stop member engaging a cooperating striker on the lock cylinder for axially moving the cylinder within the cylinder bore in the housing, a counter-bore in the forward end of the housing concentric to the cylinder bore, a circular plate rotably mounted in the counter-bore, the circular plate having an opening therethrough sized to freely receive the key therethrough.

BRIEF DESCRIPTION OF THE DRAWING

The invention will be more particularly described in reference to the accompanying drawing wherein:

FIG. 1 is a partial sectional view through an improved tumbler pin-type cylinder lock constructed in accordance with the present invention;

FIG. 2 is a partial sectional view of the lock illustrated in FIG. 1 rotated 90° counterclockwise from the view shown in FIG. 1;

FIG. 3 is an exploded partially fragmentary view of the key, stop plate and cylinder of the lock shown in FIGS. 1 and 2;

DESCRIPTION OF PREFERRED EMBODIMENTS

Figure 4:
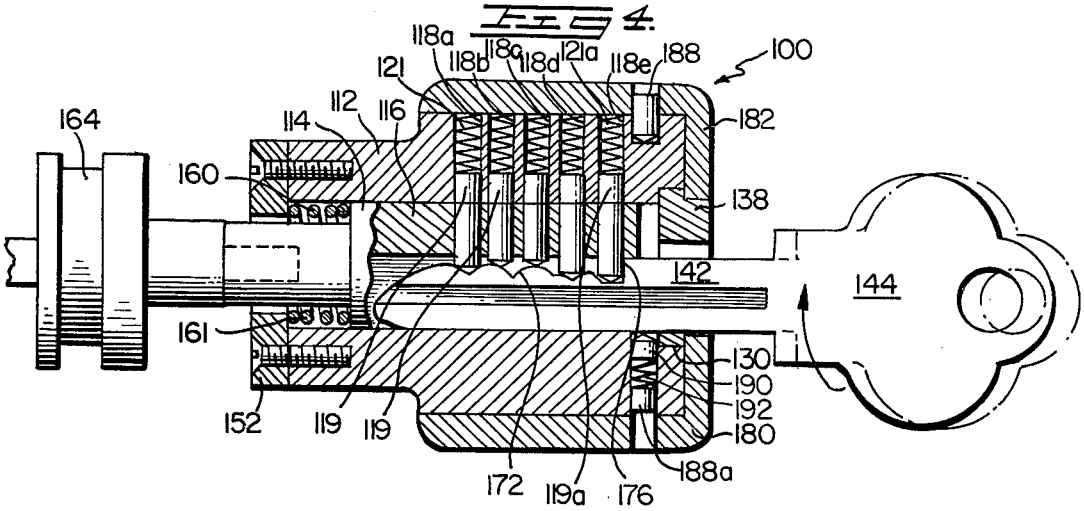
FIG. 4 is a partially sectional view of a modified form of the present invention.

Referring to the drawing and particularly FIGS. 1, 2 and 3, 10 generally designates an improved tumbler pin-type cylinder lock embodying the features of the present invention and having associated therewith automotive ignition switch means and steering wheel lock mechanism.

The lock 10 includes a cylinder housing 12 having a lock cylinder receiving bore 14 therein. Mounted within the bore 14 is a lock cylinder 16 mounted for both axial and radial movement relative to the cylinder housing 12.

The cylinder housing is provided with a plurality of bores designated 18*a, b, c* and *d,* which bores are normal to the cylinder bore 14 and positioned to intersect said bore. The bores 18*a, b, c* and *d* receive tumbler pins and tumbler pin springs (not shown). In the illustrated form of the invention, only one bank of tumblers is illustrated, however, it will be appreciated that the invention includes tumbler locks wherein there are opposed banks of tumbler pins as is known in the art.

The cylinder 16 is provided with corresponding tumbler pin bores 20*a, b, c* and *d* which receive tumbler pins, again, all as known in the art. Between the tumbler pin bores 20*a, b, c* and *d* and the shaped end 22 of the cylinder 16, the curvilinear surface of the cylinder is provided with a compound groove generally designated 24. The compound groove or slot is provided with a portion 24*a,* primarily directed in an axial direction and a portion 24*b* primarily oriented in a radial direction relative to the longitudinal length of the cylinder 16.

The lock housing 12 is provided with a further bore 26 which bore receives a pin 28, the end of which is in operative engagement with the track or groove 24 and thus controls the longitudinal and rotative motion of the lock cylinder 16.

The pin 28 may be of the type that is driven into the bore 26 after assembly of the lock, thus rendering it impossible to remove the cylinder 16 without boring the pin 28 therefrom or the pin may be just a snug fit or be provided with threads which cooperate with threads in the bore 26 so that the pin 28 may be readily removed by a locksmith.

The cylinder housing 12 is provided with a counter-bore 30, which counter-bore rotatably receives a circular protector plate 38. The protector plate is provided with an opening 40 therethrough of a size to receive the entire shank portion 42 of the key 44 as more clearly shown in FIG. 3 of the drawing. The protector plate 38 has secured to the inner face 46 thereof a pair of guide pins 48, which guide pins are slidably received in a pair of bores 50 extending in a longitudinal direction in the lock cylinder 16 so that the protector plate 38 will rotate with the lock cylinder 16 and the lock cylinder 16 may be moved longitudinally in respect to the protector plate 38 as illustrated in FIGS. 1 and 2, with FIG. 2 showing the cylinder 16 moved inwardly in respect to the protector plate 38. The protector plate 38 prevents a lock picker from urging the cylinder 16 inwardly in respect to the housing 12 by inserting a tool in the opening in the cylinder housing and forcibly driving the cylinder inwardly against the restraining effect of the tumbler pins received in the bores 18*a*–18*d* and 20*a*–20*d*.

Adjacent the forward end of the lock cylinder 16 is mounted a latch plate 52, which latch plate receives a pin 54 connected to actuating arm 56 of the locking bolt 58, which locking bolt is adapted to be receivable in a suitably shaped opening in the steering column, for example, of an automotive vehicle (not shown). The keeper plate 52 is urged away from the forward end of the lock by a helical spring 60 thus the bolt 58 is always urged into the steering column lock position accept when the key 44 positions the cylinder 16 into a bolt retracting position via shaped track 24. A further helical spring 62 urges the lock cylinder 16 in a forwardly direction and the tension in the spring is overcome by an inwardly directed force on key 44.

At the forward end of the cylinder 16 is mounted a conventional rotary switch 64 with the rotative member thereof being engaged by the shaped end of portion 66 of the cylinder. The electric rotary switch 74 may include a plurality of contact positions as more clearly illustrated by the plural conductors 70 more clearly shown in FIG. 2 of the drawings whereby the switch may be provided with a starting position, an engine operating condition; and an accessory position all as is well known in the ignition switch art.

The shank portion 42 of the key 44 is provided with a profile generally designated 72 shaped such that, when the key is in its fully inserted position, the tumbler pins (not shown in FIGS. 1–3) are in proper alignment for axial and rotative movement of the lock cylinder 16. Further, the key is provided with a stop shoulder 76 which, when the key is fully inserted, engages a cooperating stop surface 78 on the key cylinder. The function of these two surfaces are to provide force transmitting surfaces for urging the cylinder 16 in an inwardly axial direction upon inward thrusting of the key 44 as illustrated more clearly in FIG. 2 of the drawing.

To complete the assembly, the lock housing 12, the slideways for the bolt 58 and the rotary switch 64 are received in a cylindrical shield 80. The cylindrical shield 80 has an end wall 82, which end wall is provided with an axial bore 84. The axial bore 84 is of a size to freely receive the shank portion 42 of the key 44, but smaller than the cross-dimension of the safety plate or protector plate 38, thus, preventing removal of the protector plate 38 once the lock is assembled. The outer sleeve 80 may be secured to the housing 12 in any suitable manner and said attaching means may render the two elements 12 and 80 immobile in respect to each other or the covering 80 may be free to rotate relative to the cylinder housing 12 so that a wrench placed upon the sleeve 80 will merely rotate the sleeve without damaging the lock, thus, again frustrating the efforts of a lock picker.

In operation of this form of the invention, when the key 44 is inserted in the slot in the lock cylinder 16, its full amount and then further inward torque is placed upon the key, the lock cylinder 16 moves forwardly, withdrawing the bolt 58 from its lock position in, for example, the steering column of the vehicle and then rotation of the key in the direction of the directional arrow 90 to selected positions which may be marked on the face 92 of the sleeve 80 functions to operate the rotary switch 64. Withdrawal of the key 44 permits the springs 60 and 62 to urge the bolt 58 into the locking position and the cylinder 16 into the position shown in FIG. 1 of the drawing.

Figure 5:
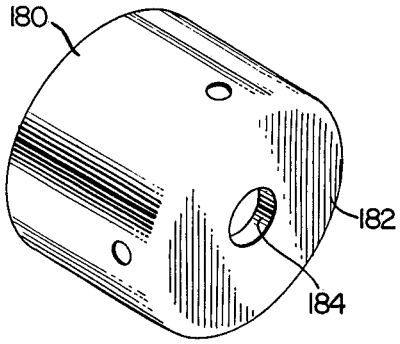
FIG. 5 is a perspective view of one of the anti-pick features of the lock shown in FIG. 4.
Figure 6:
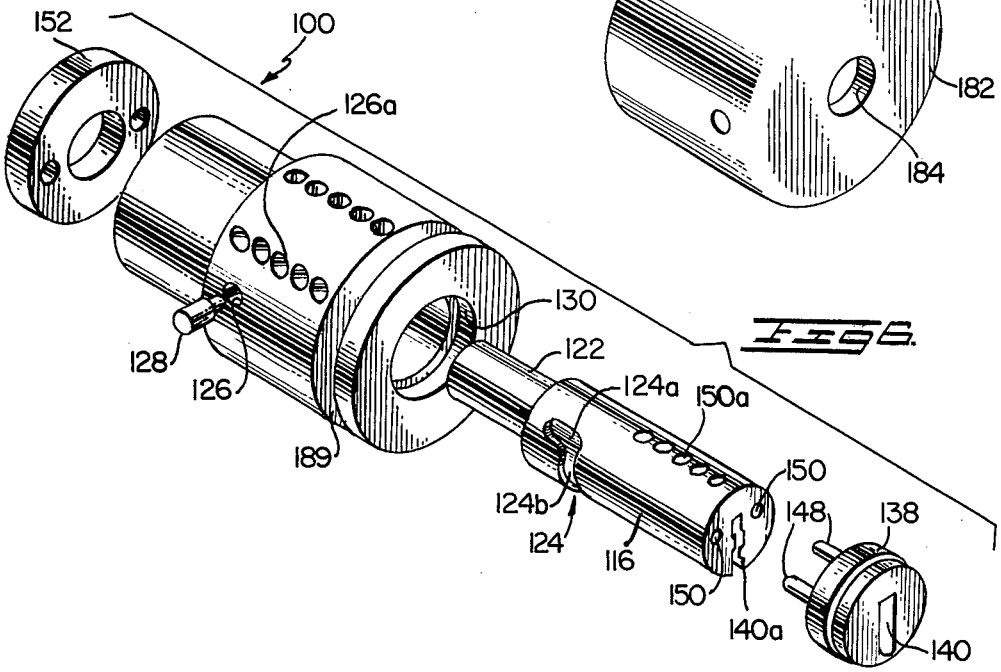
FIG. 6 is an exploded perspective view of certain of the operative mechanisms of the lock shown in FIG. 4.

Another form of a tumbler pin-type cylinder lock constructed in accordance with the teachings of the present invention is illustrated in FIGS. 4, 5 and 6. Referring to the figures, 100 generally designates a lock which may be used to actuate a rotary ignition switch of an automotive vehicle or the like. The cylinder lock 100 includes a cylindrical housing 112 bored as at 114. The bore 114 receives a lock cylinder 116, mounted for both axial and radial movement relative to the cylinder housing 112.

The cylinder housing is provided with a plurality of bores designated 118*a, b, c, d* and *e*, which bores are normal to the cylinder bore 114 and positioned to intersect said bore. The bores 118*a, b, c, d* and *e* receive tumbler pins 119 and 119*a* and tumbler pin springs 121 and 121*a*. In the illustrated form of the invention, only one bank of tumblers is illustrated, however, it will be appreciated that the invention includes tumbler locks wherein there are opposed banks of tumbler pins as is known in the art such as illustrated at 126*a*, FIG. 6.

The cylinder 116 is provided with corresponding tumbler pin bores 150*a* which receive tumbler pins, again, and a key slot 140*a*, all as known in the art. Between the tumbler pin bores and the shaped end 122 of the cylinder 116, the curvilinear surface of the cylinder is provided with a compound groove generally designated 124. The compound groove or slot is provided with a portion 124*a*, primarily directed in an axial direction and a portion 124*b* primarily oriented in a radial direction relative to the longitudinal length of the cylinder 116.

The lock housing 112 is provided with a further bore 126 which bore receives a pin 128, the end of which is in operative engagement with the track or groove 124 and thus controls the longitudinal and rotative motion of the lock cylinder 116.

The pin 128 may be of the type that is driven into the bore 126 after assembly of the lock, thus rendering it impossible to remove the cylinder 116 without boring the pin 128 therefrom or the pin may be just a snug fit or be provided with threads which cooperate with threads in the bore 126 so that the pin 128 may be readily removed by a locksmith.

The cylinder housing 112 is provided with a counterbore 130, which counter-bore rotatably receives a circular protector plate 138. The protector plate is provided with an opening 140 therethrough of a size to receive the entire shank portion 142 of the key 144 as more clearly shown in FIG. 4 of the drawing. The protector plate 138 has secured to the inner face thereof a pair of guide pins 148, which guide pins are slidably received in a pair of bores 150 extending in a longitudinal direction in the lock cylinder 116 so that the protector plate 138 will rotate with the lock cylinder 116 and the lock cylinder 116 may be moved longitudinally in respect to the protector plate 138. The protector plate 138 prevents a lock picker from urging the cylinder 116 inwardly in respect to the housing 112 by inserting a tool in the opening in the cylinder housing and forcibly driving the cylinder inwardly against the restraining effect of the tumbler pins.

At the forward end of the lock cylinder housing 112 is mounted a plate 152, which plate retains a helical spring 160 in bore 161. The spring urges the lock cylinder 116 in a forwardly direction and the tension in the spring is overcome by an inwardly directed force on key 144.

At the forward end of the cylinder 116 is mounted a conventional rotary switch 164 or the like with the rotative member thereof being engaged by the shaped end of portion 122 of the cylinder.

The shank portion 142 of the key 144 is provided with a profile generally designated 172 shaped such that, when the key is in its fully inserted position, the tumbler pins are in proper alignment for axial and rotative movement of the lock cylinder 116. Further, the key is provided with a stop shoulder 176 which, when the key is fully inserted, engages pin 119*a*. The function of these two surfaces 176 and 119*a* are to provide forces transmitting surfaces for urging the cylinder 116 in an inwardly axial direction upon inward thrusting of the key 114.

To complete the assembly, the lock housing 112 is received in a cylindrical shield 180. The cylindrical shield 180 has an end wall 182, which end wall is provided with an axial bore 184. The axial bore 184 is of a size to freely receive the shank portion 142 of the key 144, but smaller than the larges cross-dimension of the safety plate or protector plate 138 once the lock is assembled. The outer sleeve 180 is secured to the housing 122 by drive pins 188 which are received in endless groove 185 in the housing 112 so that the covering 180 may be free to rotate relative to the cylinder housing 112. Thus, a wrench placed upon the sleeve 180 will merely rotate the sleeve without damaging the lock, thus, again frustrating the efforts of a lock picker.

In order to further foil pick locks, auxilliary tumbler 190 and cooperating spring 192 may be provided between the housing 112 and the cylinder 116 as shown in FIG. 4 with the tumbler spring 192 being retained in its bore by a short pin 188*a*.

Figure 9:
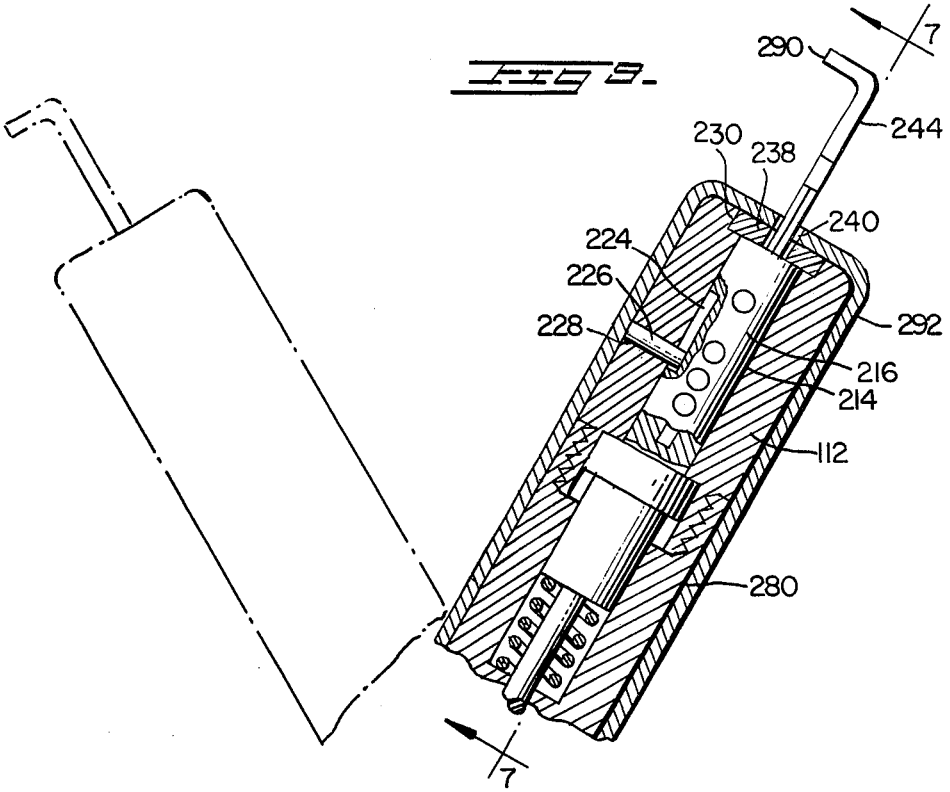
FIG. 9 is a fragmentary partially sectional view of the lock shown in FIGS. 7 and 8 illustrated in two operative positions.
Figure 7:
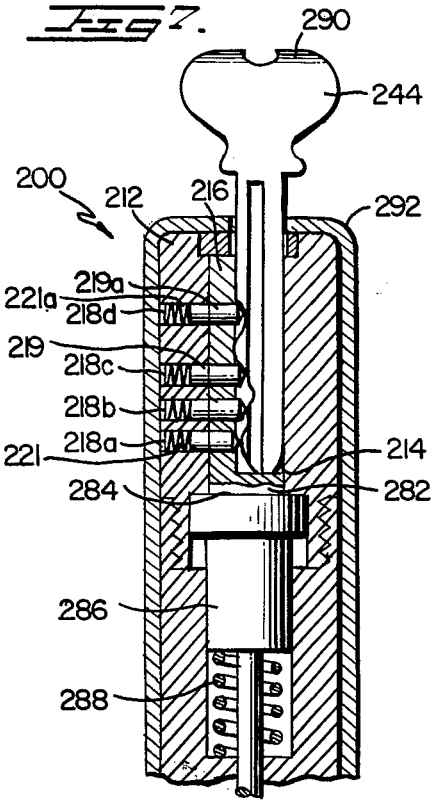
FIG. 7 is a partial sectional view through an axially moving tumbler type cylinder lock particularly adapted for locking brake handles of automotive vehicles.
Figure 8:
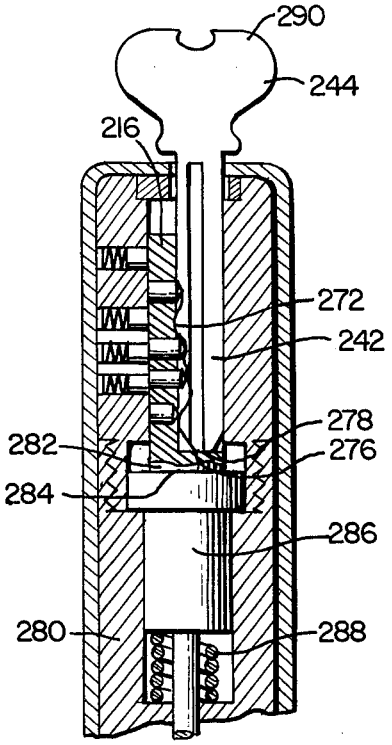
FIG. 8 is a view like FIG. 7 with the lock in the release position.

Another form of a tumbler pin-type cylinder lock constructed in accordance with the teachings of the present invention is illustrated in FIGS. 7, 8 and 9. Referring to the figures, 200 generally designates a lock which may be used to lock the brakes of an automotive vehicle or the like. The cylinder lock 200 includes a cylindrical housing 212 bored as at 214. The bore 214 receives a lock cylinder 216 mounted only for axial movement relative to the cylinder housing 212.

The cylinder housing is provided with a plurality of bores designated 218*a, b, c* and *d*, which bores are normal to the cylinder bore 214 and positioned to intersect said bore. The bores 218*a, b, c* and *d* receive tumbler pins 219 and 219*a* and tumbler pin springs 221 and 221*a*. In the illustrated form of the invention, only one bank of tumblers is illustrated, however, it will be appreciated that the invention includes pin tumbler locks wherein there are opposed banks of tumbler pins as is known in the art.

The cylinder 216 is provided with corresponding tumbler pin bores which receive tumbler pins, again, all as known in the art. Between the tumblerpin bores 220*a, b, c* and *d* and the shaped end 222 of the cylinder 216, the curvilinear surface of the cylinder is provided with a groove generally designated 224.

The lock housing 212 is provided with a further bore 226 which bore receives a pin 228, the end of which is in operative engagement with the track or groove 224 and thus controls the longitudinal motion of the lock cylinder 216.

The pin 226 may be of the type that is driven into the bore 228 after assembly of the lock, thus rendering it impossible to remove the cylinder 216 without boring the pin 228 therefrom or the pin may be just a snug fit or be provided with threads which cooperate with threads in the bore 226 so that the pin 228 may be readily removed by a locksmith.

The cylinder housing 212 is provided with a counterbore 230, which counter-bore receives a protector plate 238. The protector plate is provided with an opening 240 therethrough of a size to receive the entire shank portion 242 of the key 244 as clearly shown in the drawing.

The shank portion 242 of the key 244 is provided with a profile generally designated 272 shaped such that, when the key is in its fully inserted position, the tumbler pins are in proper alignment for axial movement of the lock cylinder 216. Further, the key is provided with a stop member 276 which, when the key is fully inserted, engages a cooperating stop surface 278 on the key cylinder. The function of these two surfaces are to provide force transmitting surfaces for urging the cylinder 216 in an inwardly axial direction upon inward thrusting of the key 244 as illustrated more clearly in FIG. 8 of the drawing.

The lock housing 212 is threadedly attached to the upper end of the emergency brake fitment 280 such that the lower end of the lock cylinder 282 abuts the top surface 284 of the conventional brake release button 286. With this arrangement, the button return spring 288 also functions to urge the lock cylinder 216 in an upwardly direction.

In order to facilitate actuation of the brake, the upper end 290 of the key 244 is smoothly bent to provide a thumb engaging surface whereby downward pressure on the surface 290 urges the cylinder 216, the brake release button, etc. downwardly against the opposite urging of spring 288. The entire assembly is provided with a hardened metal sleeve 292 which militates against removal of the tumbler pins and springs and separation of the lock housing 212 from the fitment 280 forming a portion of the brake assembly.

Having described various embodiments of my invention, what I claim is:

1. A tumbler pin-type cylinder lock comprising a housing having a cylindrical bore therein, a plurality of tumbler pin bores in the housing normal to the cylinder bore and intersecting the same, a lock cylinder mounted in the cylinder bore for controlled axial or axial and radial movement relative to the housing, a key receiving slot in the lock cylinder, cylinder control tumbler pins mounted in the tumbler pin bores, a key having a profile conforming to the tumbler pin combination and a stop member, said stop member engaging a cooperating striker on the lock cylinder for axially moving the cylinder within the cylinder bore in the housing; wherein the stop member on the key comprises a portion of the profile conforming to the tumbler pin combination and the cooperating striker on the lock cylinder comprises one of the tumbler pins.

2. In the invention defined in claim 1 further including a counter-bore in the forward end of the housing concentric to the cylinder bore, a circular plate mounted in the counter-bore, the circular plate having an opening therethrough, sized to freely receive the key therethrough.

3. The invention defined in claim 1 wherein the stop member on the key comprises an end shoulder on the key shank and the striker member on the lock cylinder comprises the outward end of the cylinder.

4. The invention defined in claim 1 wherein the stop member comprises the end of the key shank and the striker member comprises the end of the key receiving slot in the lock cylinder.

5. The invention defined in claim 1 wherein the tumbler pin-type cylinder lock is provided with an outer protective sheath, which sheath is mounted for radial movement in respect to the lock housing.

6. A tumbler pin-type cylinder lock comprising a housing having a cylindrical bore therein, a plurality of tumbler pin bores in the housing normal to the cylinder bore and intersecting the same, a lock cylinder mounted in the cylinder bore for controlled axial or axial and radial movement relative to the housing, cylinder control tumbler pins mounted in the tumbler pin bores, a key having a profile conforming to the tumbler pin combination and a stop member, said stop member engaging a cooperating striker on the lock cylinder for axially moving the cylinder within the cylinder bore in the housing; further including a counter-bore in the forward end of the housing concentric to the cylinder bore, a plate mounted in the counter-bore, the circular plate having an opening therethrough, sized to freely receive the key therethrough, and wherein the circular plate is provided with a pair of slide pins projecting normal to one face of the plate and the lock cylinder is provided with a pair of bores into which the slide pins are slidably received to thereby permit relative axial motion therebetween and cooperative rotative motion.

* * * * *